US011814878B2

(12) United States Patent
Lee, II et al.

(10) Patent No.: US 11,814,878 B2
(45) Date of Patent: Nov. 14, 2023

(54) DOOR HASP LOCK AND ASSOCIATED METHOD

(71) Applicant: Dynamic Manufacturing Group LLC, Palmetto, FL (US)

(72) Inventors: Ron J Lee, II, Ruskin, FL (US); Anthony Sansone, Parrish, FL (US)

(73) Assignee: Dynamic Manufacturing Group LLC, Palmetto, FL (US)

( * ) Notice: Subject to any disclaimer, the term of this patent is extended or adjusted under 35 U.S.C. 154(b) by 496 days.

(21) Appl. No.: 16/896,320

(22) Filed: Jun. 9, 2020

(65) Prior Publication Data

US 2021/0381280 A1 Dec. 9, 2021

(51) Int. Cl.

| | |
|---|---|
| ***E05B 67/38*** | (2006.01) |
| ***E05B 67/36*** | (2006.01) |
| ***E05B 83/02*** | (2014.01) |

(52) U.S. Cl.

CPC ..... *E05B 67/383* (2013.01); *E05B 67/36* (2013.01); *E05B 83/02* (2013.01)

(58) Field of Classification Search

CPC ..... E05B 67/383; E05B 67/36; E05B 83/02; E05B 67/38; E05B 2067/386; Y10T 70/30; Y10T 70/333; Y10T 70/20; Y10T 70/5319; Y10T 70/7921; Y10T 70/7949; Y10T 70/493; Y10T 70/496; Y10T 70/498; Y10T 70/439; Y10T 70/441; Y10T 70/443; Y10T 70/7576; Y10T 70/7582; Y10T 292/1025; Y10T 292/31

See application file for complete search history.

(56) References Cited

U.S. PATENT DOCUMENTS

| | | | | |
|---|---|---|---|---|
| 3,721,112 A * | 3/1973 | Wellekens | ..... | E05B 67/24 70/52 |
| 3,744,280 A * | 7/1973 | Brown, Jr. | ..... | E05B 67/38 292/231 |
| 3,907,344 A * | 9/1975 | Newlon | ..... | E05C 3/167 292/66 |
| 4,095,828 A * | 6/1978 | East | ..... | E05B 67/383 292/148 |
| 4,932,692 A * | 6/1990 | Nelson | ..... | E05B 67/383 292/148 |

(Continued)

FOREIGN PATENT DOCUMENTS

| | | |
|---|---|---|
| EP | 0952050 | * 10/1999 |
| GB | 2289712 | * 11/1995 |

*Primary Examiner* — Christine M Mills
*Assistant Examiner* — Christopher F Callahan

(57) ABSTRACT

A door hasp lock includes a first lock plate having a first flange and a first shield. A second lock plate is detachably engaged with the first lock plate and has a second flange detachably engaged with the first flange. The second lock plate has a third flange. The first lock plate and the second lock plate are engaged and disengaged when disposed at an operating locked state and a non-operating unlocked state, respectively. The third flange is spaced apart from the first flange and the second flange while the door hasp lock is disposed at both the operating locked state as well as the non-operating unlocked state. The third flange may be attached to either the first lock plate or second lock plate and has at least one feature that permits the third flange to break away from the second lock plate when tampered by an unauthorized user.

9 Claims, 15 Drawing Sheets

(56) References Cited

U.S. PATENT DOCUMENTS

| | | | | | |
|---|---|---|---|---|---|
| 5,127,244 | A * | 7/1992 | Myers | E05B 67/36 | 70/32 |
| 5,172,574 | A * | 12/1992 | Perfetto | E05B 67/38 | 292/281 |
| 5,345,794 | A * | 9/1994 | Jenks | E05B 67/36 | 70/32 |
| 7,290,415 | B2 * | 11/2007 | Rosenberg | E05B 67/383 | 70/56 |
| 7,562,546 | B2 * | 7/2009 | Taylor | E05B 67/36 | 70/32 |
| 7,610,784 | B2 * | 11/2009 | Rohde | E05B 67/383 | 70/56 |
| 8,347,661 | B2 * | 1/2013 | Kaminsky, Jr. | E05B 67/383 | 70/56 |
| 9,551,167 | B2 * | 1/2017 | Pickard | E05B 67/06 | |
| 9,845,056 | B1 * | 12/2017 | Lovas | B60P 3/14 | |
| 11,098,501 | B2 * | 8/2021 | Ramsay | E05C 19/08 | |
| 2008/0141745 | A1 * | 6/2008 | Rohde | E05B 17/18 | 70/455 |
| 2009/0133450 | A1 * | 5/2009 | Uliano | E05B 67/36 | 70/51 |
| 2011/0198866 | A1 * | 8/2011 | Benson | E05B 67/383 | 292/150 |
| 2014/0260445 | A1 * | 9/2014 | Vellani | E05B 67/383 | 70/101 |
| 2015/0211263 | A1 * | 7/2015 | Bullwinkel | E05B 21/06 | 70/344 |
| 2017/0037662 | A1 * | 2/2017 | Braun | E05B 67/383 | |

* cited by examiner

DOOR HASP LOCK AND ASSOCIATED METHOD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to hasp locks and, more particularly, to a door hasp lock containing a feature for storing a locking member when the door hasp lock is at an unlocked state.

Prior Art

The use of locks on the outside of trailer doors is known and typical. Regardless of the type of trailer from the smallest to large tractor trailers, the method of securing the trailer is basically the same and needs to be improved. The disadvantage of the outside-style lock is that it is easy for thieves to break by cutting the lock or lock hasps. To limit access to a trailer's contents, owners of trailers will commonly back up heavy equipment against the trailer door when they leave the trailer. Tractor trailers occasionally will be backed up to a wall when left overnight. Owners of trailers try the methods described above because of the lack of effective security systems.

When the trailer is detached from the vehicle, the locking member must be either carried by the user or stored in a designated location. Such requirements are inconvenient and may lead to stolen locking members. U.S. Pat. No. 7,562,546 tried to solve this problem but requires a specific hook-shaped securing member that is attached to the door hasp lock. The use of the specific hook-shaped securing member limits the ability to interchangeably use a variety of conventional locks with the door hasp lock.

Alternate conventional door hasp locks require the user to secure the lock on the main locking protrusion of the door hasp lock. This inhibits full functioning of the door because the user must remove the locking member and close the doors while holding the locking member.

Accordingly, a need remains for door hasp lock in order to overcome at least one aforementioned shortcoming. The exemplary embodiment(s) satisfy such a need by providing a door hasp lock that is convenient and easy to use, lightweight yet durable in design, versatile in its applications, and designed for storing a locking member when the door hasp lock is at an unlocked state.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a door hasp lock containing a feature for storing a locking member when the door hasp lock is at an unlocked state. These and other objects, features, and advantages of the non-limiting exemplary embodiment(s) are provided by a door hasp lock for use with a trailer. Such a door hasp lock includes a first lock plate having a first planar anterior surface, a first flange statically coupled to the first planar anterior surface, and a first shield statically coupled to the first planar anterior surface. A second lock plate is detachably engaged with the first lock plate and has a second planar anterior surface, a second flange statically coupled to the second planar anterior surface and being detachably engaged with the first flange, a third flange statically coupled to the second planar anterior surface, and a second shield statically coupled to the second planar anterior surface.

Advantageously, the first lock plate and the second lock plate are engaged and disengaged when disposed at an operating locked state and a non-operating unlocked state, respectively. Advantageously, the third flange is spaced apart from the first flange and the second flange while the door hasp lock is disposed at both the operating locked state as well as the non-operating unlocked state. Advantageously, the third flange has at least one feature that permits the third flange to break away from the second lock plate when tampered by an unauthorized user. Thus, a thief cannot steal the second lock plate together with the locking member. The locking member will break off with the third flange and, the second lock plate will remain at the trailer, thereby rendering the second lock plate useless.

In a non-limiting exemplary embodiment, each of the first shield and the second shield may have an arcuate shape.

In a non-limiting exemplary embodiment, the door hasp lock further includes a locking member is removably affixed to the first flange and the second flange when the door hasp lock is disposed at the operating locked state. Such a locking member is situated between the first shield and the second shield.

In a non-limiting exemplary embodiment, the locking member is detached from both of the first flange and the second flange, as well as attached to the third flange, when the door hasp lock is disposed at the non-operating locked state. Advantageously, the locking member is situated exterior of the first shield and the second shield.

In a non-limiting exemplary embodiment, a third shield is statically coupled to the first planar anterior surface of the first lock plate and spaced apart from the first shield and the second shield.

In a non-limiting exemplary embodiment, the first shield and the second shield are configured in a generally annular pattern about the first flange and the second flange.

In a non-limiting exemplary embodiment, the generally annular pattern is configured to receive the locking member therein.

In a non-limiting exemplary embodiment, the first flange has a first aperture, the second flange has a second aperture, and the third flange has third aperture. Advantageously, the locking member is configured to removably pass through the first aperture and the second aperture when the door hasp lock is disposed at the operating locked state. Advantageously, the locking member is configured to removably pass through the third aperture when the door hasp lock is disposed at the non-operating unlocked state.

In a non-limiting exemplary embodiment, the locking member includes a rigid cover having a plurality of slots, a locking cylinder operably engaged with selective ones of the slots, a locking implement slidably positioned within the locking cylinder and operably engaged with alternate ones of the slots, and a key operably engaged with the locking implement for slidably reciprocating the locking cylinder between locked and unlocked positions. Advantageously, the locking cylinder is selectively locked to the first flange and the second flange, when the door hasp lock is disposed at the operating locked state. Advantageously, the locking cylinder is selectively locked to the third flange when the door hasp lock is disposed at the non-operating unlocked state.

The present disclosure further includes a method of utilizing a door hasp lock with a trailer. Such a method includes the steps of: providing a first lock plate having a first planar anterior surface, a first flange statically coupled to the first planar anterior surface, and a first shield statically coupled to the first planar anterior surface; providing and detachably engaging a second lock plate with the first lock plate, wherein the second lock plate has a second planar anterior surface, a second flange statically coupled to the second planar anterior surface and detachably engaged with the first flange, a third flange statically coupled to the second planar anterior surface, and a second shield statically coupled to the second planar anterior surface.

The method further includes the step of: disposing the door hasp lock at an operating locked state and a non-operating unlocked state by engaging and disengaging the first lock plate and the second lock plate, respectively. Each of the first shield and the second shield has an arcuate shape. The third flange has at least one feature that permits the third flange to break away from the second lock plate when tampered by an unauthorized user. The third flange is spaced apart from the first flange and the second flange while the door hasp lock is disposed at both the operating locked state as well as the non-operating unlocked state.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
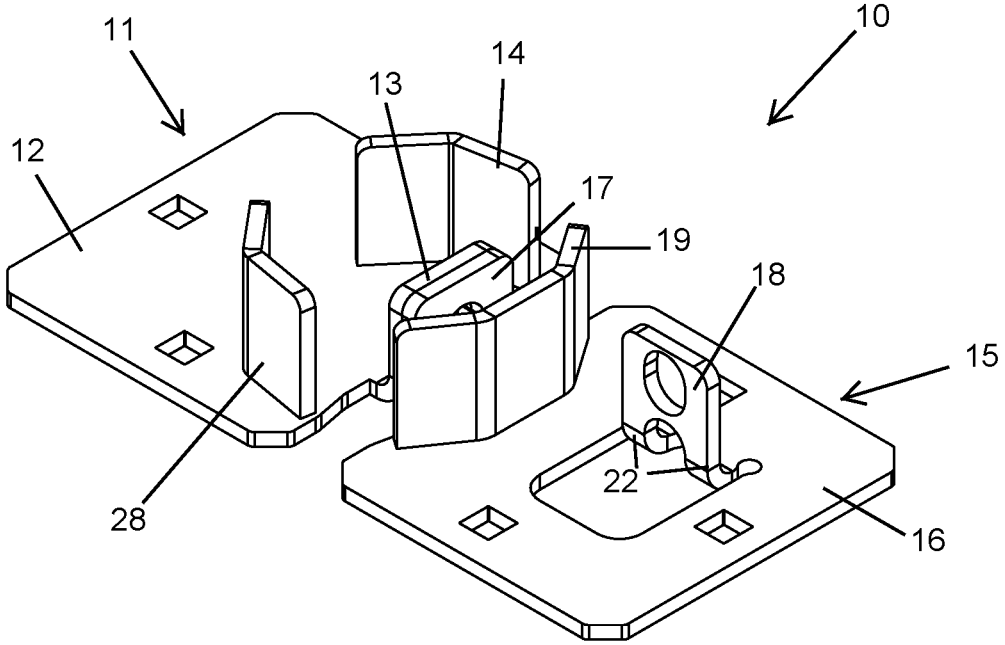
FIG. 1 is a perspective view of a door hasp lock, in accordance with a non-limiting exemplary embodiment of the present disclosure.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" or "generally" means approximately or nearly and in the context of a numerical value or range set forth means ±15% of the numerical.

If used herein, "substantially" means largely if not wholly that which is specified but so close that the difference is insignificant.

Figure 2:
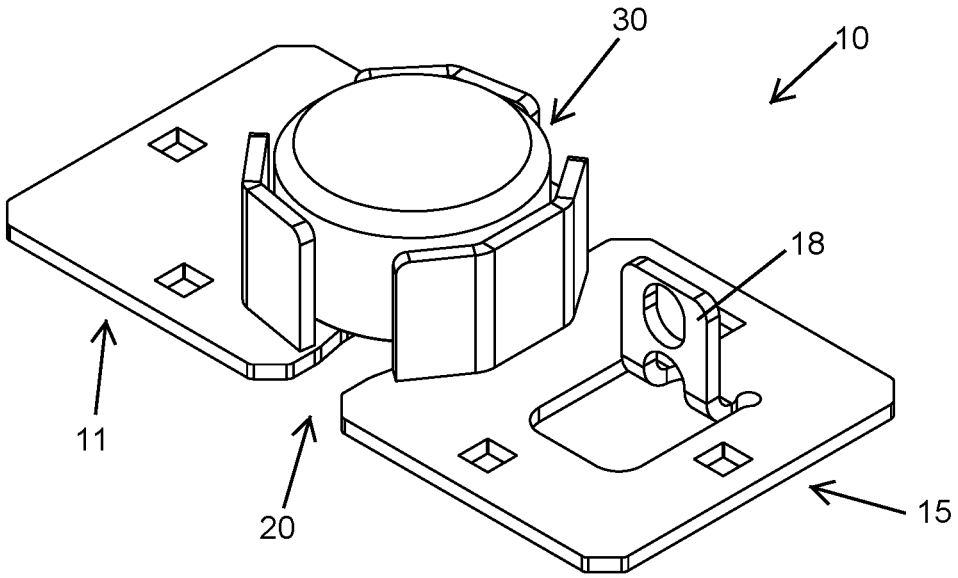
FIG. 2 is a perspective view of the door hasp lock shown in FIG. 1 wherein a locking member is attached to the door hasp lock disposed at a locked operating state.
Figure 3:
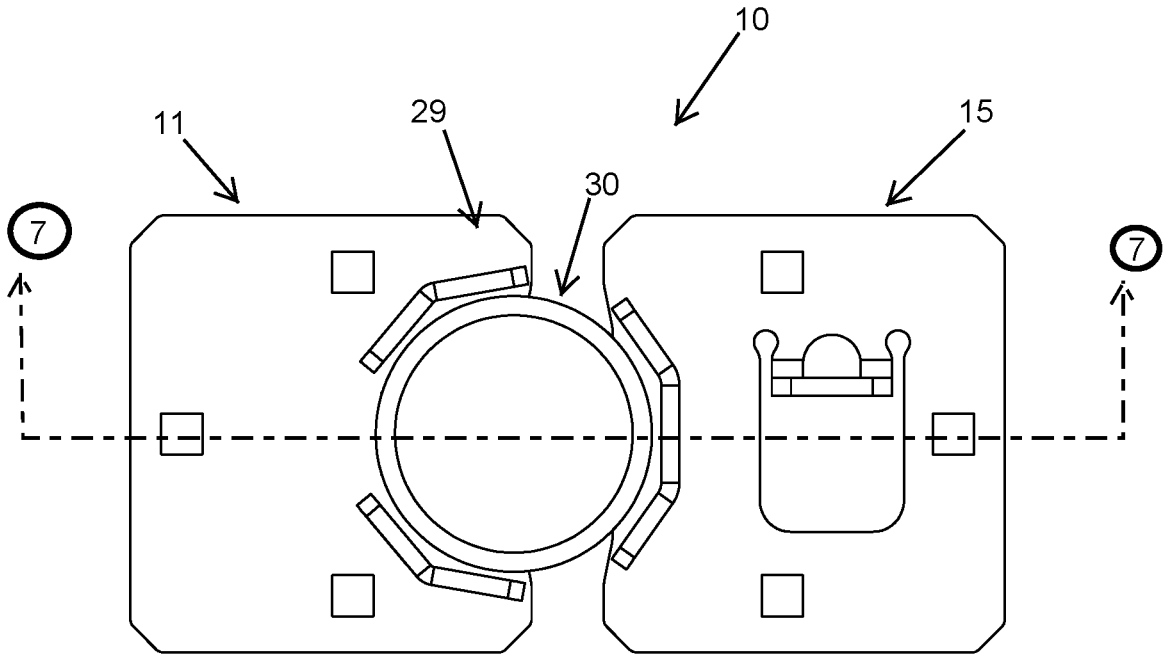
FIG. 3 is a top plan view of the door hasp lock shown in FIG. 2.
Figure 4:
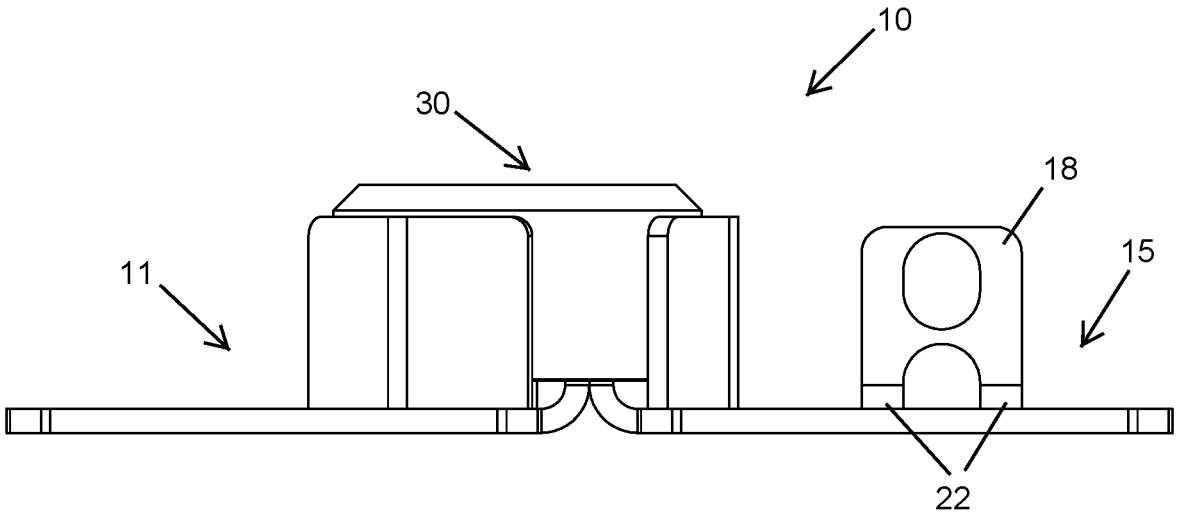
FIG. 4 is a side elevational view of the door hasp lock shown in FIG. 2.
Figure 5:
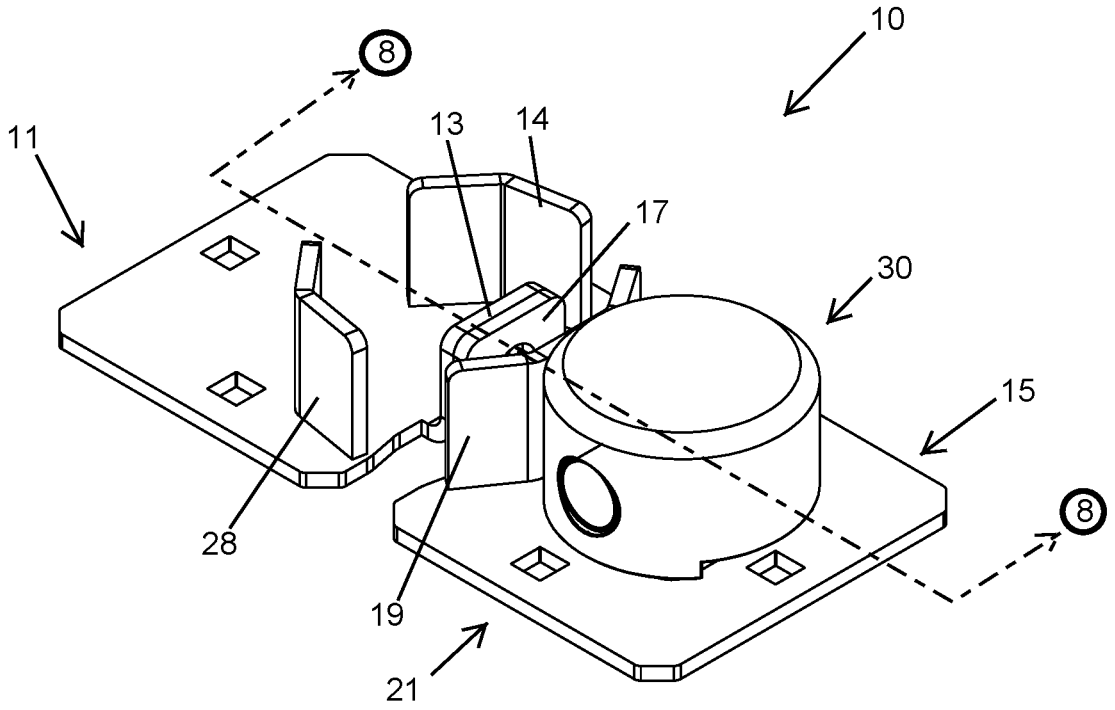
FIG. 5 is a perspective view of the door hasp lock shown in FIG. 1 wherein the locking member is attached the door hasp lock disposed at an unlocked non-operating state.
Figure 6:
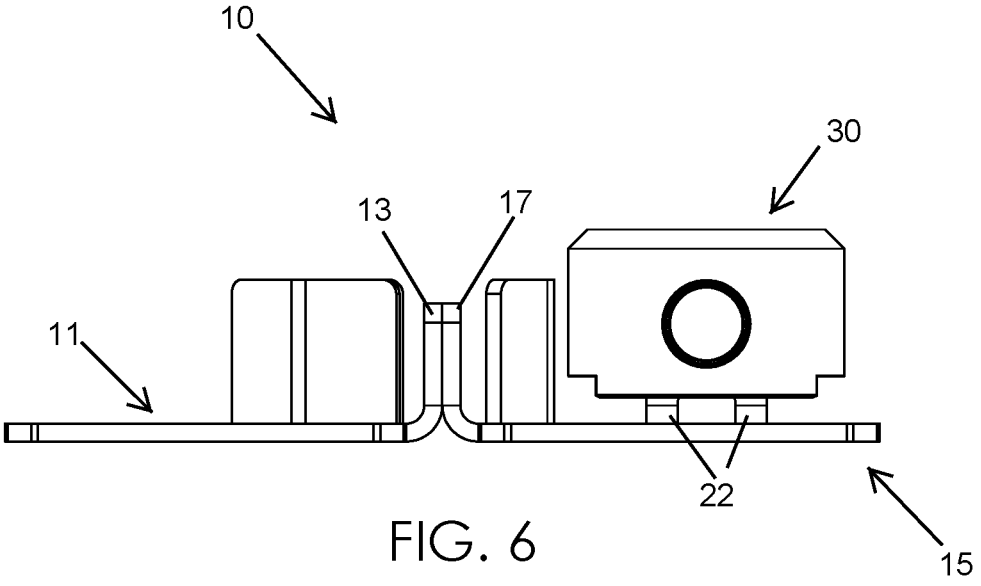
FIG. 6 is a side elevational view of the door hasp lock shown in FIG. 5.
Figure 7:
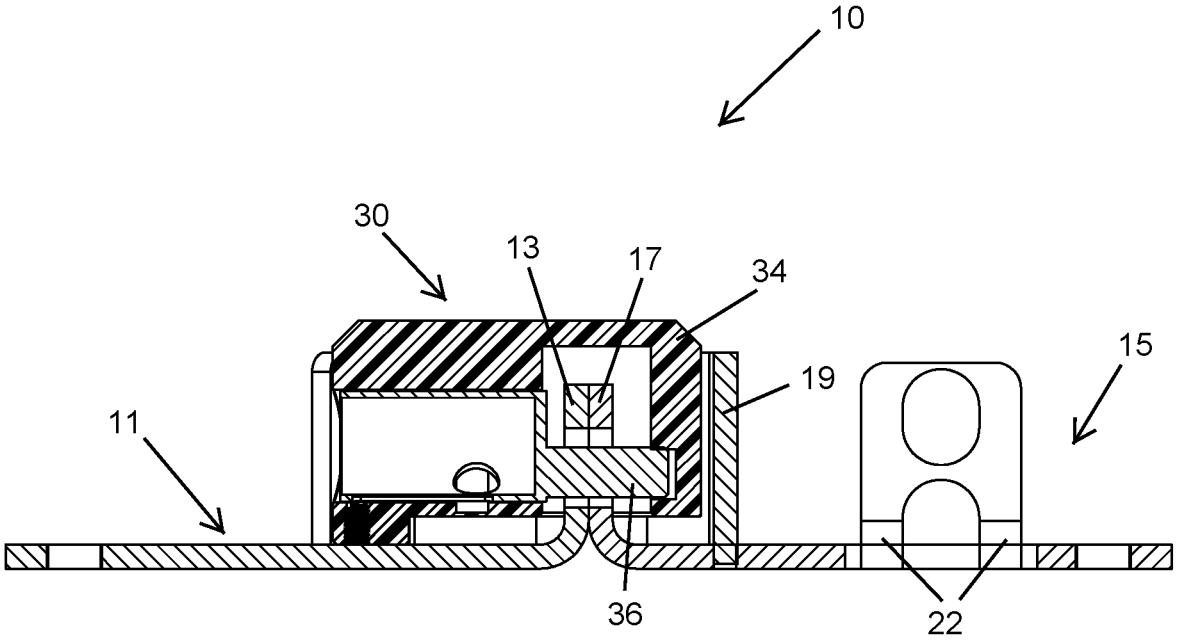
FIG. 7 is a cross-sectional view taken along line 7-7 in FIG. 3.
Figure 8:
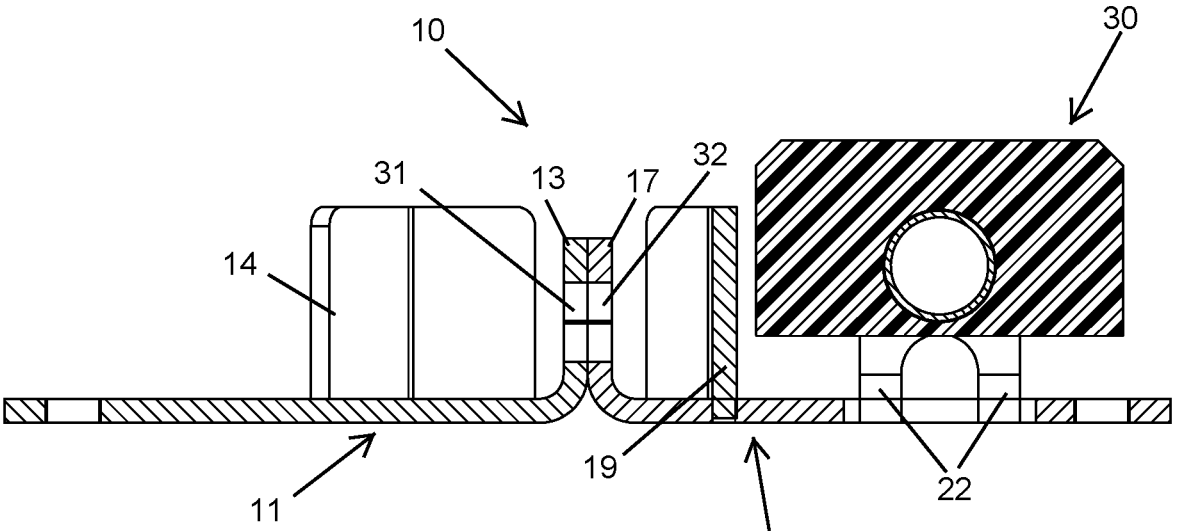
FIG. 8 is a cross-sectional view taken along line 8-8 in FIG. 5.
Figure 9:
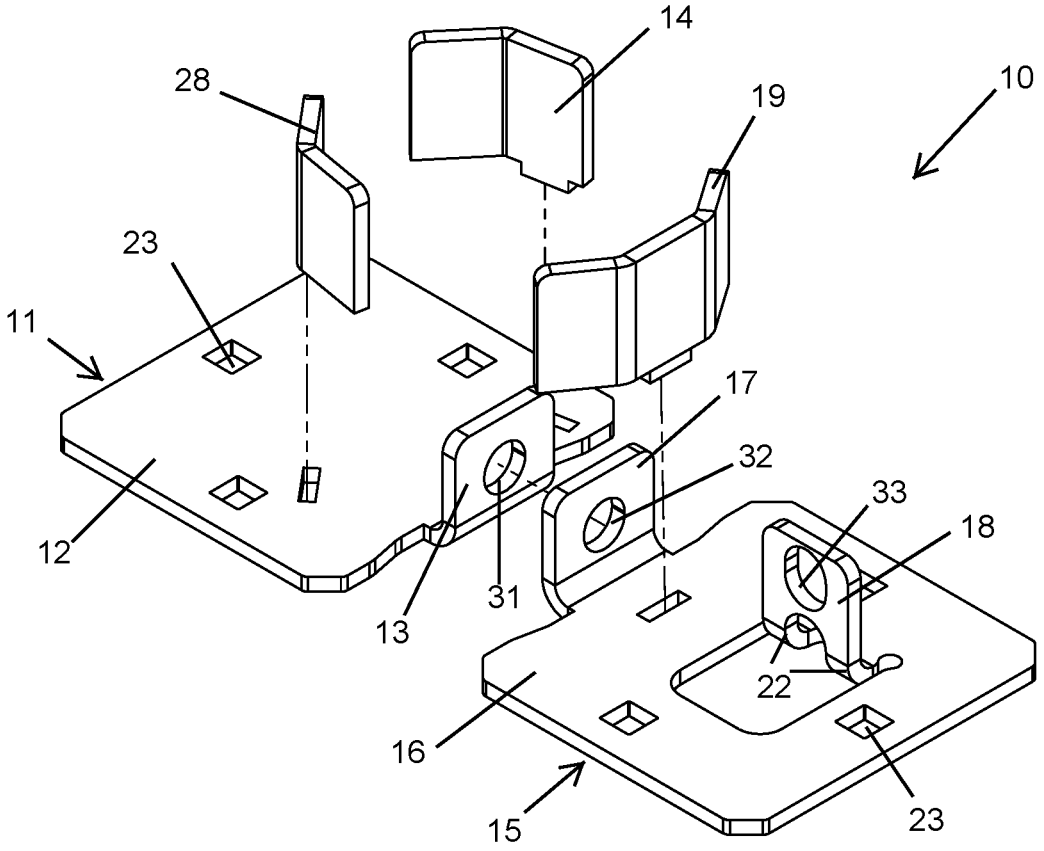
FIG. 9 is an exploded view of the door hasp lock shown in FIG. 1.
Figure 10:
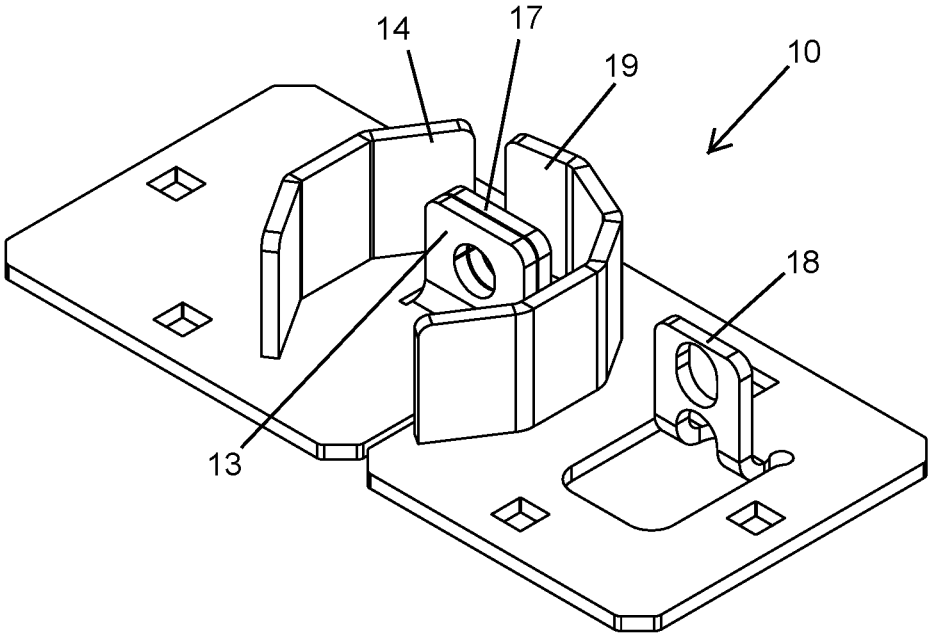
FIG. 10 is a perspective view of the door hasp lock, in accordance with another non-limiting exemplary embodiment of the present disclosure.
Figure 11:
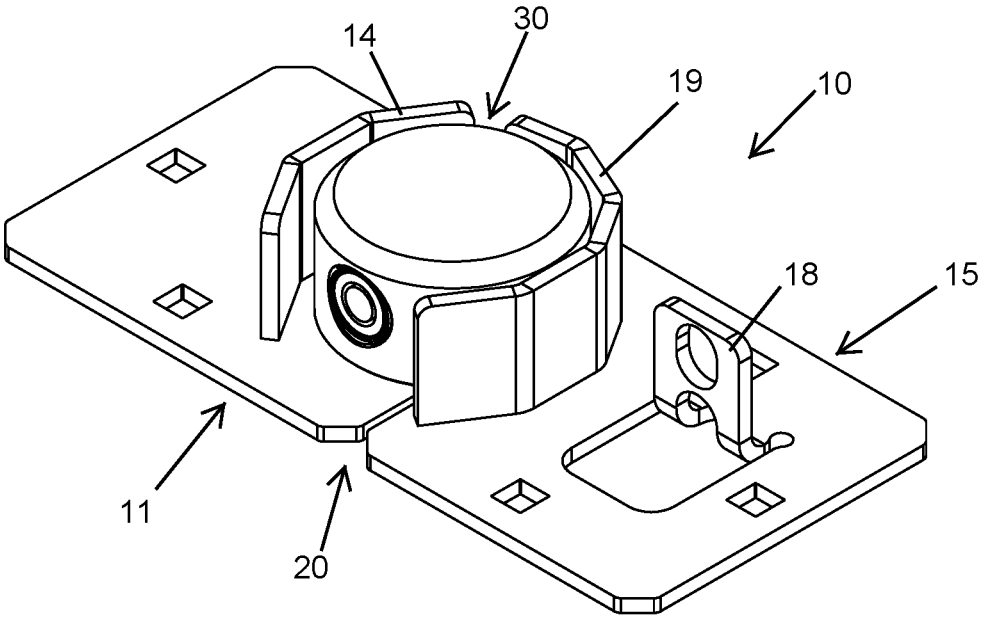
FIG. 11 is a perspective view of the door hasp lock shown in FIG. 10 wherein a locking member is attached to the door hasp lock disposed at a locked operating state.
Figure 12:
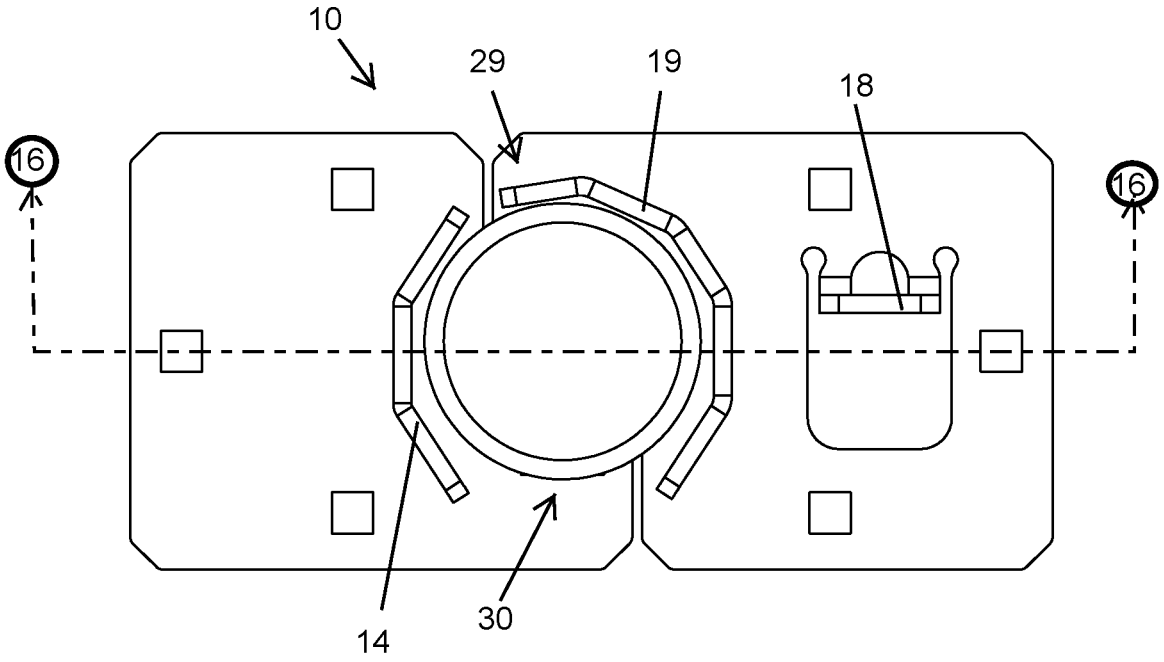
FIG. 12 is a top plan view of the door hasp lock shown in FIG. 11.
Figure 13:
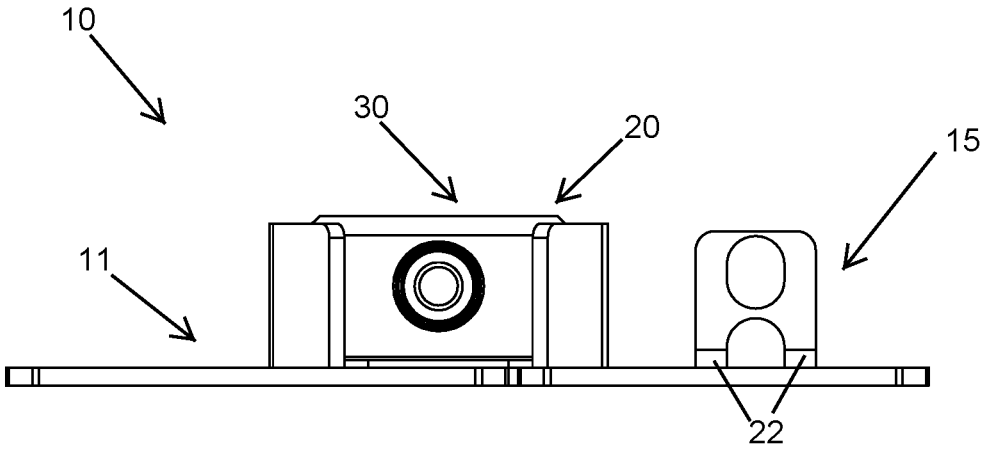
FIG. 13 is a side elevational view of the door hasp lock shown in FIG. 11.
Figure 14:
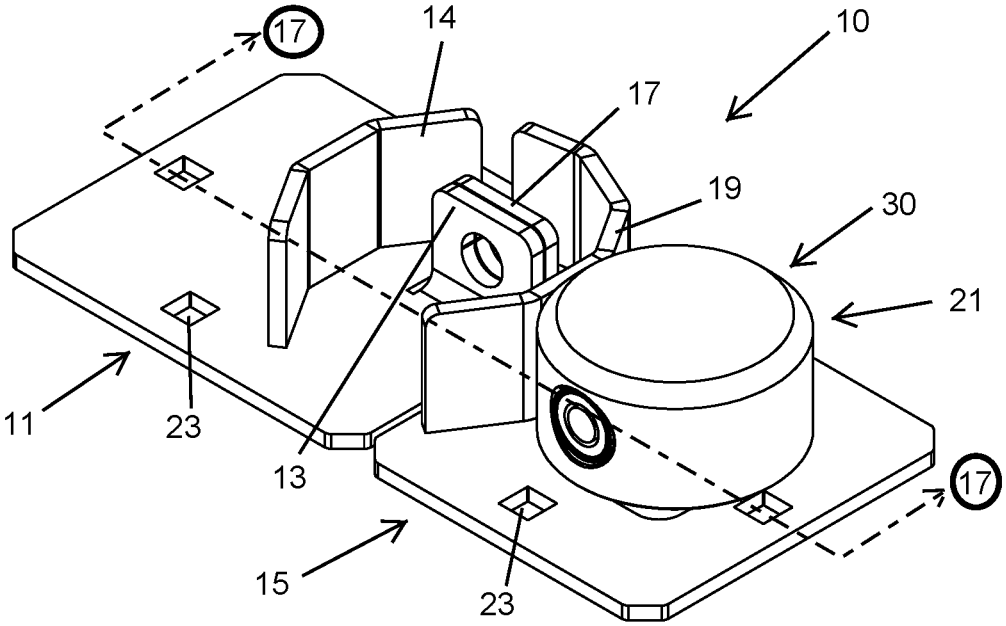
FIG. 14 is a perspective view of the door hasp lock shown in FIG. 10 wherein the locking member is attached the door hasp lock disposed at an unlocked non-operating state.
Figure 15:
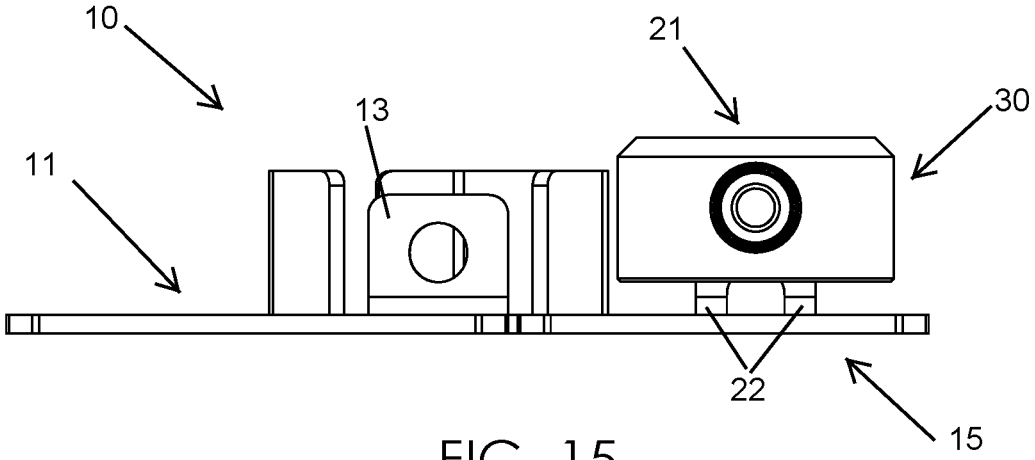
FIG. 15 is a side elevational view of the door hasp lock shown in FIG. 14.
Figure 16:
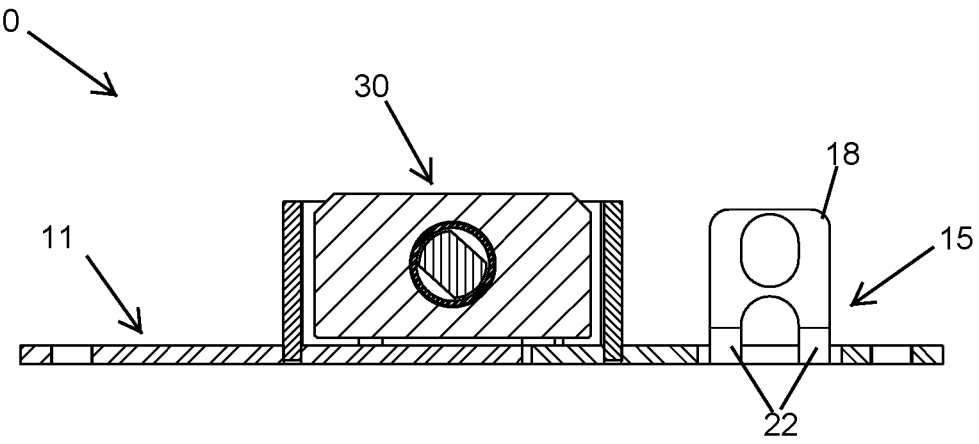
FIG. 16 is a cross-sectional view taken along line 16-16 in FIG. 12.
Figure 17:
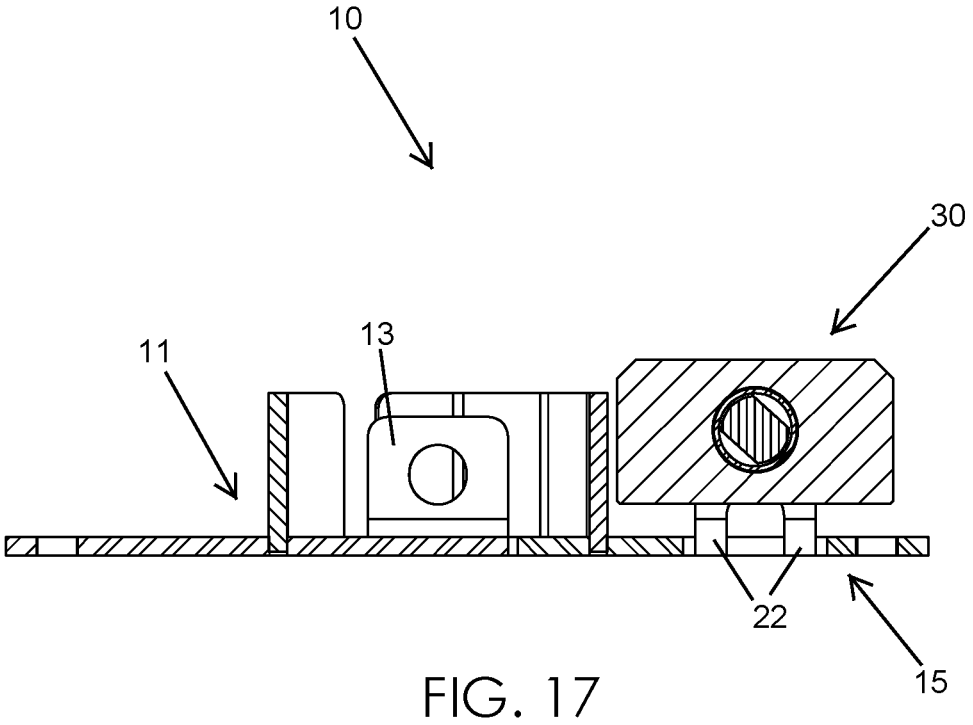
FIG. 17 is a cross-sectional view taken along line 17-17 in FIG. 14.
Figure 18:
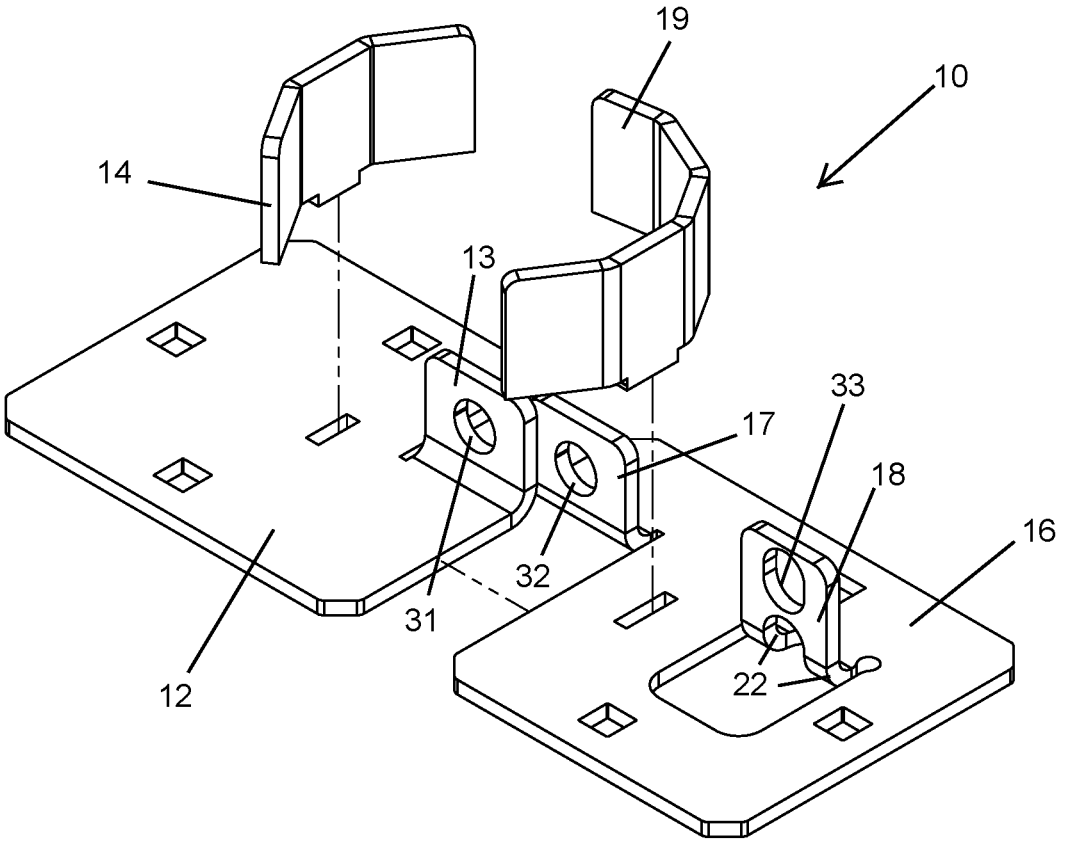
FIG. 18 is an exploded view of the door hasp lock shown in FIG. 10.
Figure 19:
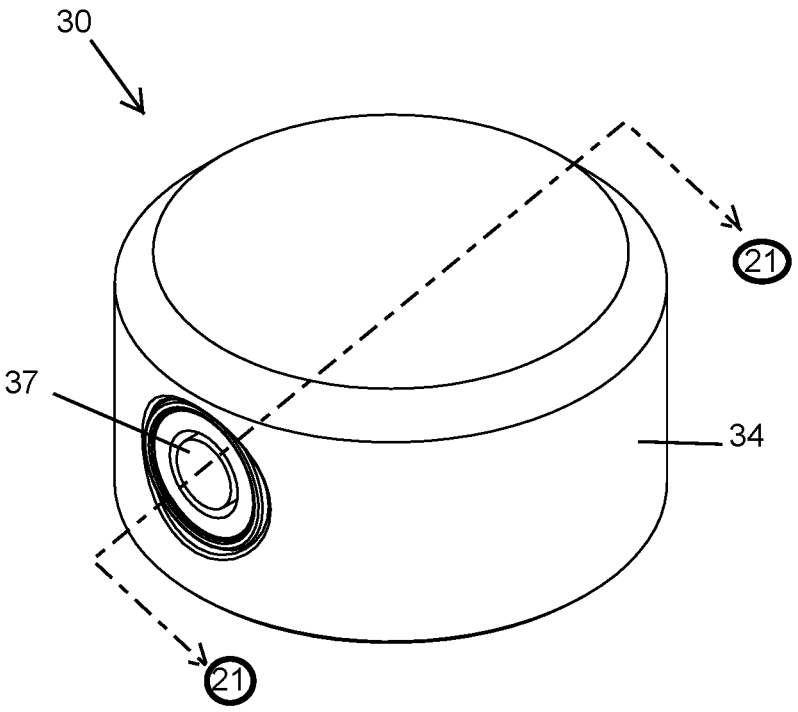
FIG. 19 is a perspective view of a locking member, in accordance with a non-limiting exemplary embodiment of the present disclosure.
Figure 20:
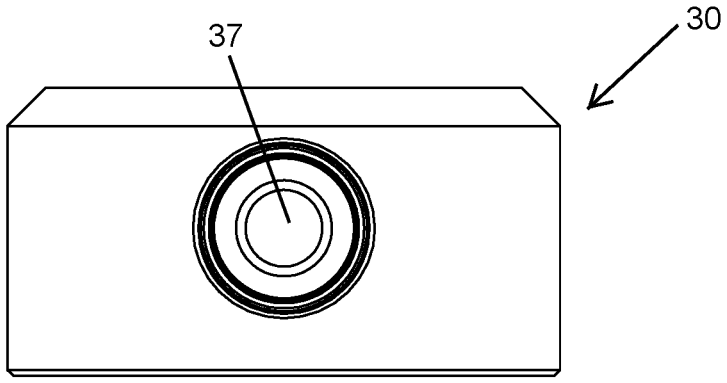
FIG. 20 is a front elevational view of the locking member shown in FIG. 19.
Figure 21:
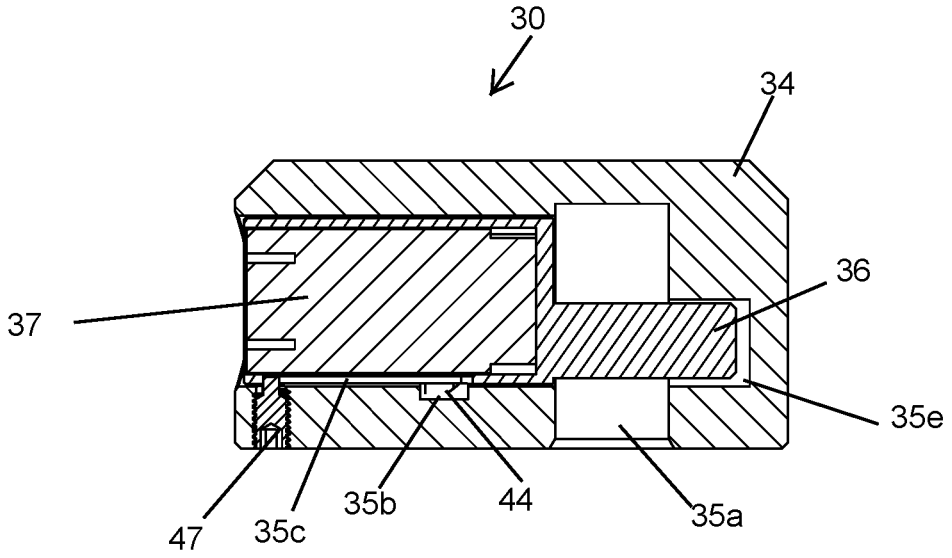
FIG. 21 is a cross-sectional view taken along line 21-21 in FIG. 19.
Figure 22:
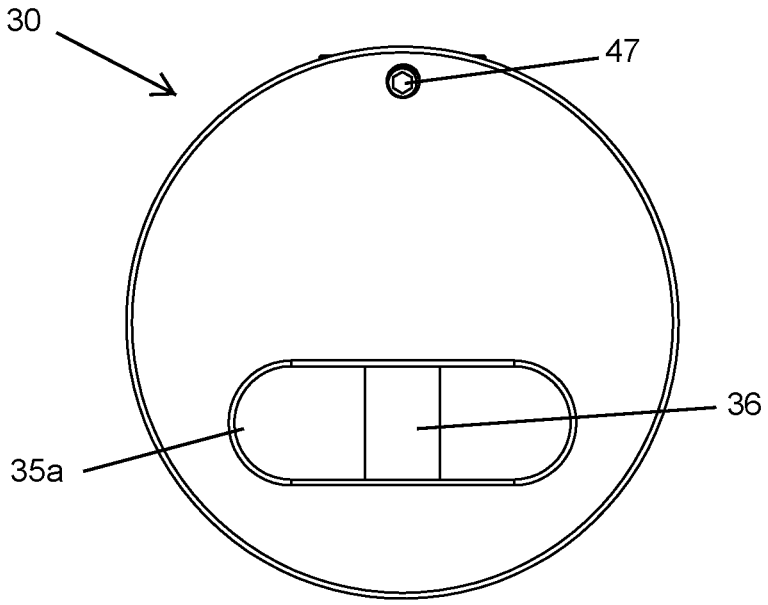
FIG. 22 is a bottom plan view of the hidden shackle padlock shown in FIG. 19.
Figure 23:
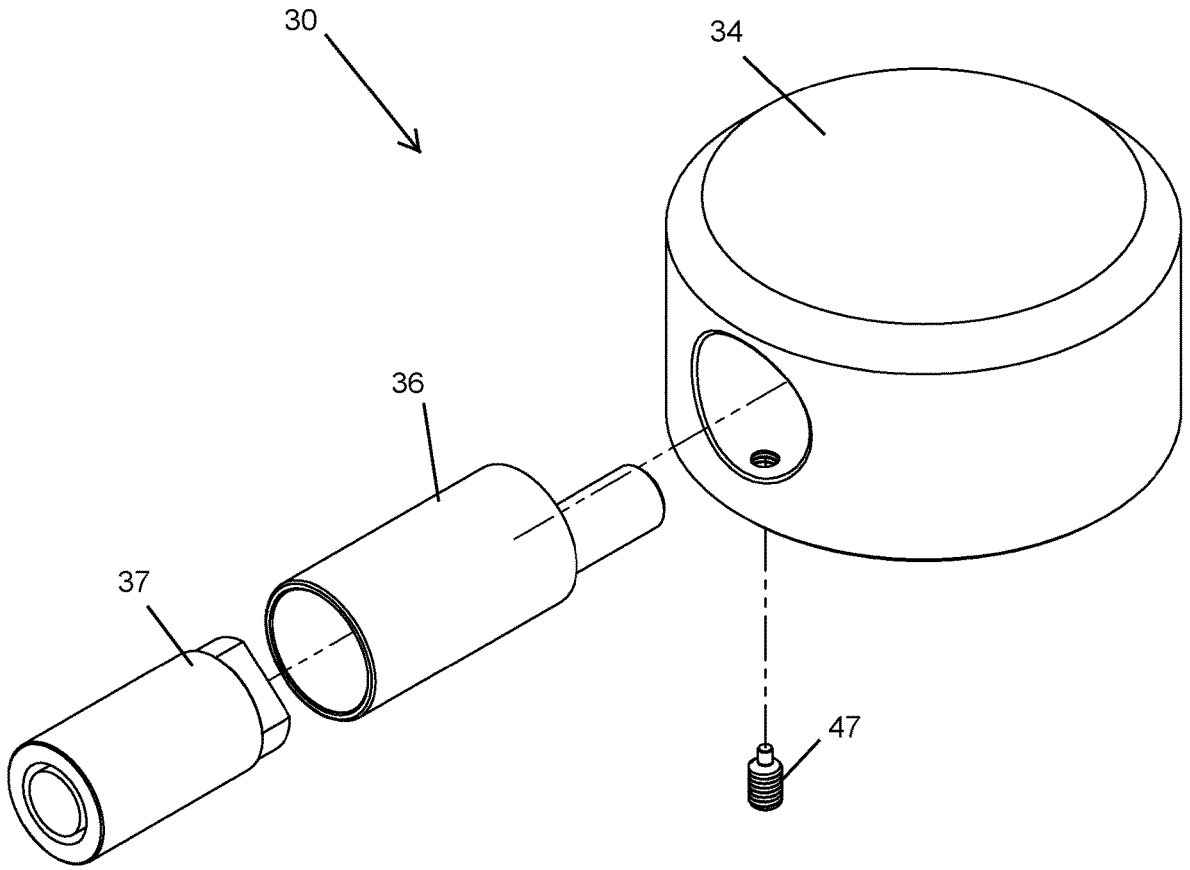
FIG. 23 is a top exploded view of the hidden shackle padlock shown in FIG. 19.
Figure 24:
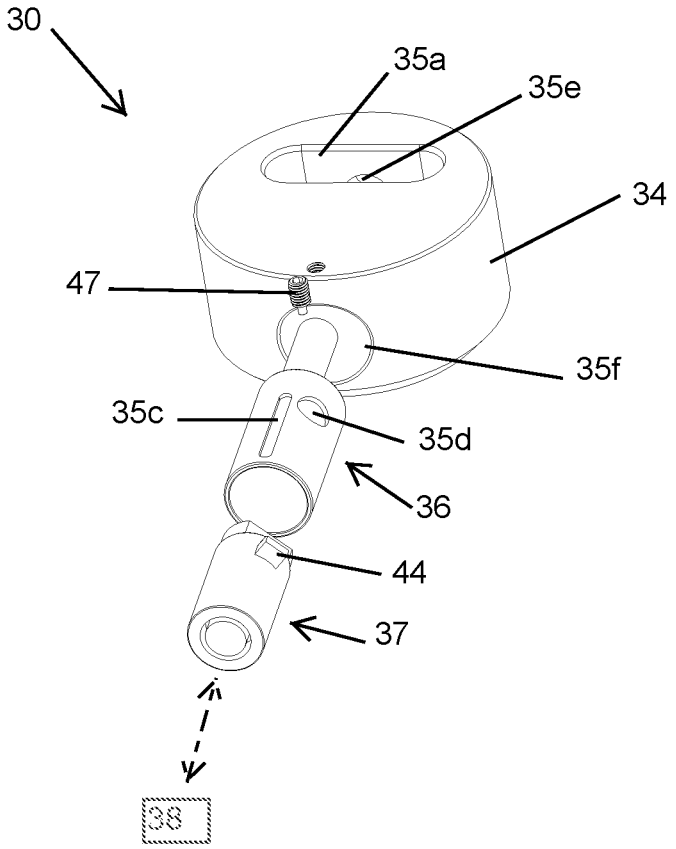
FIG. 24 is a bottom exploded view of the hidden shackle padlock shown in FIG. 19.
Figure 25:
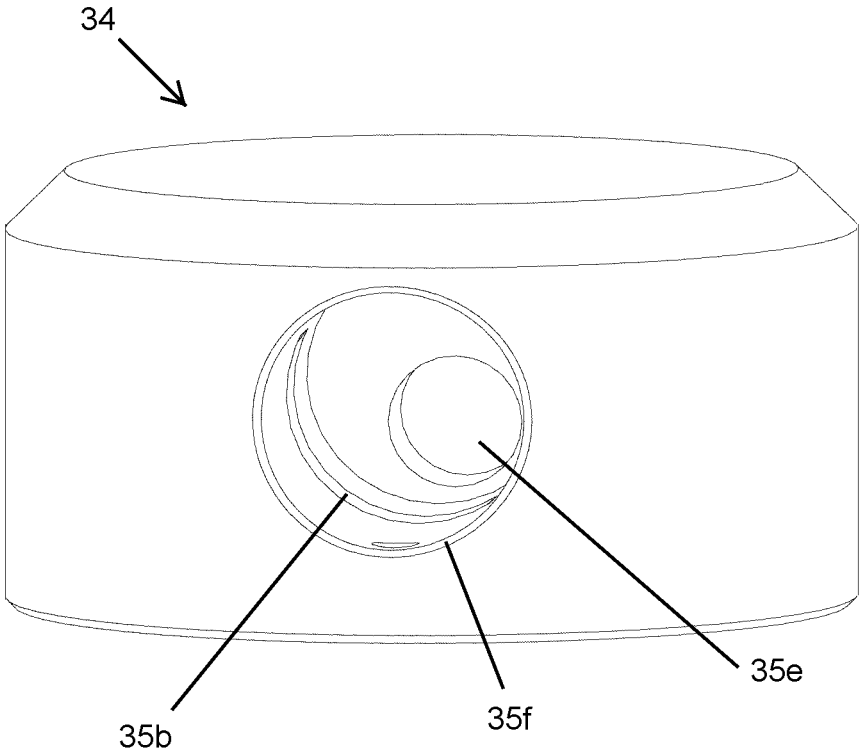
FIG. 25 is a perspective view of the hidden shackle padlock cover.

The non-limiting exemplary embodiment(s) is/are referred to generally in FIGS. 1-25 and is/are intended to provide a door hasp lock 10 containing a feature for storing a locking member 30 when the door hasp lock 10 is at an unlocked state. The door hasp lock 10 may be used with a trailer or the like. Advantageously, the door hasp lock 10 includes a third flange 18 for temporary storage of the locking member 30 (e.g., hidden shackle lock, pad lock, combination lock, etc.) while not in use. It is noted that a variety of locks may be used. The configuration of the third flange 18 may be similar to the first flange 13 and the second flange 17, therefore it does not introduce any restrictions and allows for the use of a variety of locking device. Advantageously, the third flange 18 can be used to secure the locking member 30 while not in use (e.g., the doors are open and you need a place to store the locking member 30). The third flange 18 will break off before enough force is applied to overcome the method of attachment of the second lock plate 15 to the trailer/door/wall.

Referring again to FIGS. 1-25, the door hasp lock 10 includes a first lock plate 11 having a first planar anterior surface 12, a first flange 13 statically coupled to the first planar anterior surface 12, and a first shield 14 statically coupled (e.g., welded) to the first planar anterior surface 12. A second lock plate 15 is detachably engaged with the first lock plate 11 and has a second planar anterior surface 16, a second flange 17 statically coupled to the second planar anterior surface 16 and detachably engaged with the first flange 13, a third flange 18 statically coupled to the second planar anterior surface 16, and a second shield 19 statically coupled (e.g., welded) to the second planar anterior surface 16. Such a structural configuration provides the new, useful, and unexpected result of enabling a user to temporarily store a locking member 30 at the second lock plate 15 (via the third flange 18) when the trailer doors are open, for example, while protecting the locking member 30 from unauthorized access (e.g., prying away the locking member from the first flange 13 and second flange 17). Notably, the third flange 18 has break away portions 22 that prevent a thief from using the third flange 18 as a leverage point to remove the second lock plate 15 from the trailer. The third flange 18 will break off before enough force is applied to overcome the method of attachment of the second lock plate 15 to the trailer/door/wall. It is noted the third flange 18 may be attached to either the first lock plate 11 or second lock plate 15.

Advantageously, the first flange 13 and second flange 17 are directly engaged (abutted) when the first lock plate 11 and the second lock plate 15 are engaged and disengaged (e.g., disposed at an operating locked state 20 and a non-operating unlocked state 21), respectively. Advantageously, the third flange 18 is spaced apart from the first flange 13 and the second flange 17 while the door hasp lock 10 is disposed at both the operating locked state 20 as well as the non-operating unlocked state 21. Advantageously, the third flange 18 has at least one feature that permits the third flange 18 to break away from the second lock plate 15 when tampered by an unauthorized user. Such a feature may include one or more portions of weakness 22 (e.g., bend, shoulder) having a reduced cross-sectional thickness, for example. Such a structural configuration provides the new, useful, and unexpected result of preventing a thief from using the third flange 18 as a leverage point to remove the second lock plate 15 from the trailer. The third flange 18 will break off before enough force is applied to overcome the method of attachment of the second lock plate 15 to the trailer/door/wall. In other words, the third flange 18 will break off and the second lock plate 15 will remain at the trailer, thereby rendering the door hasp lock 10 useless. As noted above, the third flange 18 may be attached to either the first lock plate 11 or second lock plate 15.

Each of the first lock plate 11 and second lock plate 15 having holes 23 for receiving fasteners therethrough when being secured to a trailer's doors, for example.

In a non-limiting exemplary embodiment, each of the first shield 14 and the second shield 19 may have an arcuate shape.

In a non-limiting exemplary embodiment, the door hasp lock 10 further includes a locking member 30 is removably affixed to the first flange 13 and the second flange 17 when the door hasp lock 10 is disposed at the operating locked state 20. Such a locking member 30 is situated between the first shield 14 and the second shield 19, and thereby protected from unauthorized tampering (e.g., using a crowbar to pry off the locking member 30 from the first flange 13 and second flange 17).

In a non-limiting exemplary embodiment, the locking member 30 is detached from both of the first flange 13 and the second flange 17, as well as attached to the third flange 18, when the door hasp lock 10 is disposed at the non-operating locked state 21. Advantageously, the locking member 30 is situated exterior of the first shield 14 and the second shield 19. Such a structural configuration provides the new, useful, and unexpected result of enabling a user to temporarily store locking member 30 at the second lock plate 15 when the trailer doors are open, for example. As noted above, such a structural configuration further provides the new, useful, and unexpected result of preventing a thief from using the third flange 18 as a leverage point to remove the second lock plate 15 from the trailer. The third flange 18 will break off before enough force is applied to overcome the method of attachment of the second lock plate 15 to the trailer/door/wall. In other words, the third flange 18 will break off and the second lock plate 15 will remain at the trailer, thereby rendering the door hasp lock 10 useless. As noted above, the third flange 18 may be attached to either the first lock plate 11 or second lock plate 15.

In a non-limiting exemplary embodiment, a third shield 28 is statically coupled to the first planar anterior surface 12 of the first lock plate 11 and spaced apart from the first shield 14 and the second shield 19. Such a structural configuration provides the new, useful, and unexpected result of intercalating locking member 30 between the first shield 14, the second shield 19, and the third shield 28 thereby protecting locking member 30 from unauthorized tampering (e.g., using a crowbar to pry off the locking member 30 from the first flange 13 and second flange 17).

In a non-limiting exemplary embodiment, the first shield 14 and the second shield 19 are configured in a generally annular pattern 29 about the first flange 13 and the second flange 17. Such an annular pattern 29 substantially conforms to the annular shape of the locking member 30 (e.g., hidden shackle padlock).

In a non-limiting exemplary embodiment, the generally annular pattern 29 is configured to receive the locking member 30 therein. Such a structural configuration provides the new, useful, and unexpected result of shielding the locking member 30 from unauthorized tampering while the trailer doors are closed, for example.

In a non-limiting exemplary embodiment, the first flange 13 has a first aperture 31, the second flange 17 has a second aperture 32, and the third flange 18 has third aperture 33. Advantageously, the locking member 30 is configured to removably pass through the first aperture 31 and the second aperture 32 when the door hasp lock 10 is disposed at the operating locked state 20. Advantageously, the locking member 30 is configured to removably pass through the third aperture 33 when the door hasp lock 10 is disposed at the non-operating unlocked state 21. Such a structural configuration provides the new, useful, and unexpected result of enabling a user to temporarily store a locking member 30 at the second lock plate 15 when the trailer doors are open, for example.

In a non-limiting exemplary embodiment, the locking member 30 includes a rigid cover 34 having a plurality of slots 35 (35*a*, 35*b*, 35*e*, 35*f*), a locking cylinder 36 operably engaged with selective ones of the slots 35*e*, 35*f*; a locking implement 37 slidably positioned within the locking cylinder 36 and having additional slots 35*c*, 35*d*. The locking implement 37 having a resilient finger 44 operably engaged with alternate ones of the slots 35*b*, 35*d* (e.g., 35*b* may be either diametrically opposed circular slots or a curvilinear slot 35*b* shown in FIG. 25), and a key 38 operably engaged with the locking implement 37 for slidably reciprocating the locking cylinder 36 between locked and unlocked positions. Advantageously, the locking cylinder 36 is selectively locked (e.g., passed through) to the first flange 13 and the second flange 17, when the door hasp lock 10 is disposed at the operating locked state 20. Advantageously, the locking cylinder 36 is selectively locked (e.g., passed through) to the third flange 18 when the door hasp lock 10 is disposed at the non-operating unlocked state 21. A threaded screw 47 is rotatably anchored to the cover 34 and provides a guide along which the locking cylinder 36 slides via slot 35*c*. As noted hereinabove, a variety of locking members 30 may be employed. There is no need to specifically employ the hidden shackle padlock described herein.

The present disclosure further includes a method of utilizing a door hasp lock 10 with a trailer. Such a method includes the steps of: providing a first lock plate 11 having a first planar anterior surface 12, a first flange 13 statically coupled to the first planar anterior surface 12, and a first shield 14 statically coupled to the first planar anterior surface 12; providing and detachably engaging a second lock plate 15 with the first lock plate 11 (e.g., directly abutting, engaging, and aligning the first flange 13 to the second flange 17), wherein the second lock plate 15 has a second planar anterior surface 16, a second flange 17 statically coupled to the second planar anterior surface 16 and detachably engaged with the first flange 13, a third flange 18 statically coupled to the second planar anterior surface 16, and a second shield 19 statically coupled to the second planar anterior surface 16.

The method further includes the step of: disposing the door hasp lock 10 at an operating locked state 20 and a non-operating unlocked state 21 by engaging and disengaging the first lock plate 11 (e.g., first flange 13) and the second lock plate 15 (e.g., second flange 17), respectively. Each of the first shield 14 and the second shield 19 has an arcuate shape. The third flange 18 has at least one feature that permits the third flange 18 to break away from the second lock plate 15 when tampered by an unauthorized user. The third flange 18 is spaced apart from the first flange 13 and the second flange 17 while the door hasp lock 10 is disposed at both the operating locked state 20 as well as the non-operating unlocked state 21. Such a structural configuration provides the new, useful, and unexpected result of preventing a thief from using the third flange 18 as a leverage point to remove the second lock plate 15 from the trailer. The third flange 18 will break off before enough force is applied to overcome the method of attachment of the second lock plate 15 to the trailer/door/wall. In other words, the third flange 18 will break off and the second lock plate 15 will remain at the trailer, thereby rendering the door hasp lock 10 useless. As noted above, the third flange 18 may be attached to either the first lock plate 11 or second lock plate 15.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A door hasp lock for use with a trailer, comprising:

a first lock plate having a first planar anterior surface, a first flange statically coupled to said first planar anterior surface, and a first shield statically coupled to said first planar anterior surface; and a second lock plate detachably engaged with said first lock plate and having a second planar anterior surface, a second flange statically coupled to said second planar anterior surface and being detachably engaged with said first flange, a third flange statically coupled to said second planar anterior surface, and a second shield statically coupled to said second planar anterior surface;

wherein said first lock plate and said second lock plate are engaged and disengaged when disposed at an operating locked state and a non-operating unlocked state, respectively;

wherein said third flange is spaced apart from said first flange and said second flange while said door hasp lock is disposed at both the operating locked state as well as the non-operating unlocked state;

wherein each of said first shield and said second shield has an arcuate shape;

wherein said third flange has at least one feature that permits said third flange to break away from said second lock plate when tampered by an unauthorized user.

2. The door hasp lock of claim 1, further comprising: a locking member removably affixed to said first flange and said second flange when said door hasp lock is disposed at the operating locked state, said locking member being situated between said first shield and said second shield.

3. The door hasp lock of claim 2, wherein said locking member is detached from both of said first flange and said second flange, as well as attached to said third flange, when said door hasp lock is disposed at the non-operating unlocked state, said locking member being situated exterior of said first shield and said second shield.

4. The door hasp lock of claim 3, further comprising: a third shield statically coupled to said first planar anterior surface of said first lock plate and spaced apart from said first shield and said second shield.

5. The door hasp lock of claim 4, wherein said first shield and said second shield are configured in a generally annular pattern about said first flange and said second flange.

6. The door hasp lock of claim 5, wherein said generally annular pattern is configured to receive said locking member therein.

7. The door hasp lock of claim 3, wherein said first flange has a first aperture, said second flange has a second aperture, and said third flange has third aperture;

wherein said locking member is configured to removably pass through said first aperture and said second aperture when said door hasp lock is disposed at the operating locked state;

wherein said locking member is configured to removably pass through said third aperture when said door hasp lock is disposed at the non-operating unlocked state.

8. The door hasp lock of claim 3, wherein said locking member comprising:

a rigid cover having a plurality of slots;

a locking cylinder operably engaged with selective ones of said slots;

a locking implement slidably positioned within said locking cylinder and operably engaged with alternate ones of said slots; and a key operably engaged with said locking implement for slidably reciprocating said locking cylinder between locked and unlocked positions;

wherein said locking cylinder is selectively locked to said first flange and said second flange, when said door hasp lock is disposed at the operating locked state;

wherein said locking cylinder is selectively locked to said third flange when said door hasp lock is disposed at the non-operating unlocked state.

9. A method of utilizing a door hasp lock with a trailer, said method comprising the steps of:

providing a first lock plate having a first planar anterior surface, a first flange statically coupled to said first planar anterior surface, and a first shield statically coupled to said first planar anterior surface;

providing and detachably engaging a second lock plate with said first lock plate, said second lock plate having a second planar anterior surface, a second flange statically coupled to said second planar anterior surface and being detachably engaged with said first flange, a third flange statically coupled to said second planar anterior surface, and a second shield statically coupled to said second planar anterior surface; and disposing said door hasp lock at an operating locked state and a non-operating unlocked state by engaging and disengaging said first lock plate and said second lock plate, respectively;

wherein each of said first shield and said second shield has an arcuate shape;

wherein said third flange has at least one feature that permits said third flange to break away from said second lock plate when tampered by an unauthorized user;

wherein said third flange is spaced apart from said first flange and said second flange while said door hasp lock is disposed at both the operating locked state as well as the non-operating unlocked state.

* * * * *